United States Patent [19]

Glover

[11] Patent Number: 4,754,633

[45] Date of Patent: Jul. 5, 1988

[54] METHODS AND APPARATUS FOR DRAWING WIRE

[75] Inventor: Alan C. Glover, Winona, Canada

[73] Assignee: Stelco Inc., Hamilton, Canada

[21] Appl. No.: 940,838

[22] Filed: Dec. 12, 1986

[30] Foreign Application Priority Data

Jan. 30, 1986 [CA] Canada ..... 500715

[51] Int. Cl.[4] ..... B21C 1/12

[52] U.S. Cl. ..... 72/289; 72/288; 72/279

[58] Field of Search ..... 72/289, 285, 279, 288, 72/280, 66; 242/78

[56] References Cited

U.S. PATENT DOCUMENTS

| | | | |
|---|---|---|---|
| 2,127,989 | 8/1938 | Barron et al. | 72/66 |
| 2,220,048 | 10/1940 | Mueller | 72/279 |
| 2,900,073 | 8/1959 | Blake et al. . | |
| 2,927,744 | 3/1960 | Nye et al. | 242/82 |
| 3,163,058 | 12/1964 | Hunter | 80/4 |
| 3,177,690 | 4/1965 | McIlvried, Jr. | 72/66 |

FOREIGN PATENT DOCUMENTS

| | | | |
|---|---|---|---|
| 718233 | 11/1954 | United Kingdom | 72/289 |
| 908252 | 10/1962 | United Kingdom | 72/280 |

*Primary Examiner*—Daniel C. Crane

*Attorney, Agent, or Firm*—Fleit, Jacobson, Cohn & Price

[57] ABSTRACT

Wire drawing apparatus employs a wire take-up device, a rotatable pay-off device and, located therebetween, a rotating wire drawing die. Mounted on the pay-off device is a coil of material from which wire is drawn by the apparatus. This material may be in the form of rod, for example, and, for the sake of simplicity, will be referred to as such hereinafter. The axis of the pay-off device and rod coil thereon, the axis of the take-up device and the wire coil formed thereon and the axis of rotation of the rotating die all are parallel to each other and preferably, but not necessarily, coaxial. A differential speed compensating drive is connected to and drives the pay-off device in the same direction as the die to compensate for the elongation of the rod as it is drawn into wire. The rod is maintained and transferred in substantially the form of a coil between the pay-off device and the take-up device and passes through the die, which rotates in a plane between the pay-off and take-up devices.

9 Claims, 4 Drawing Sheets

METHODS AND APPARATUS FOR DRAWING WIRE

BACKGROUND OF THE INVENTION

This invention relates to the drawing of wire and provides novel and useful apparatus and techniques (methods) for drawing wire.

Wire normally is drawn from a product known as rod which, when the material is steel, typically is in the form of a loose, irregular coil weighing 1600 to 2500 lbs. For ease of understanding, the material from which wire is drawn in accordance with this invention will be referred to hereinafter as rod, but this is to be construed as exemplary only. The material may be in other forms. For example, it may be wire that is to be drawn into smaller diameter.

A number of different drawing techniques and apparatus are known. As these can best be understood with reference to drawings, it now will be necessary to refer to certain of the drawings. The drawings appended to and forming part of this patent application may be described briefly as follows:

Background of the Invention (Continued)

Figure 1:
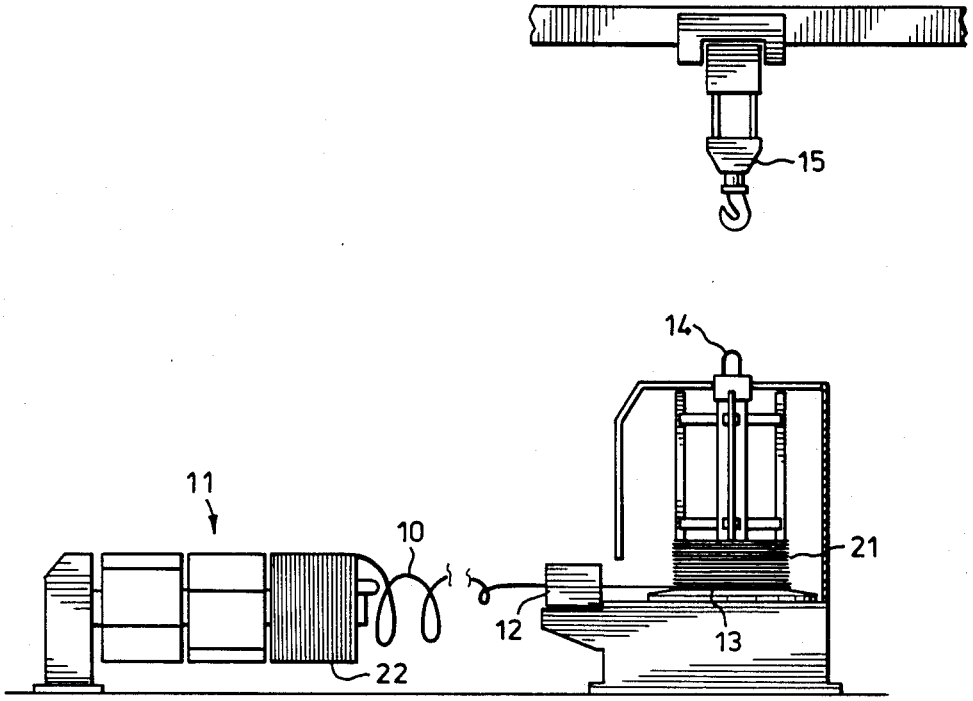
FIG. 1 (PRIOR ART)
FIGS. 1 and 2 are sketches of two types of prior art wire drawing apparatus.
Figure 2:
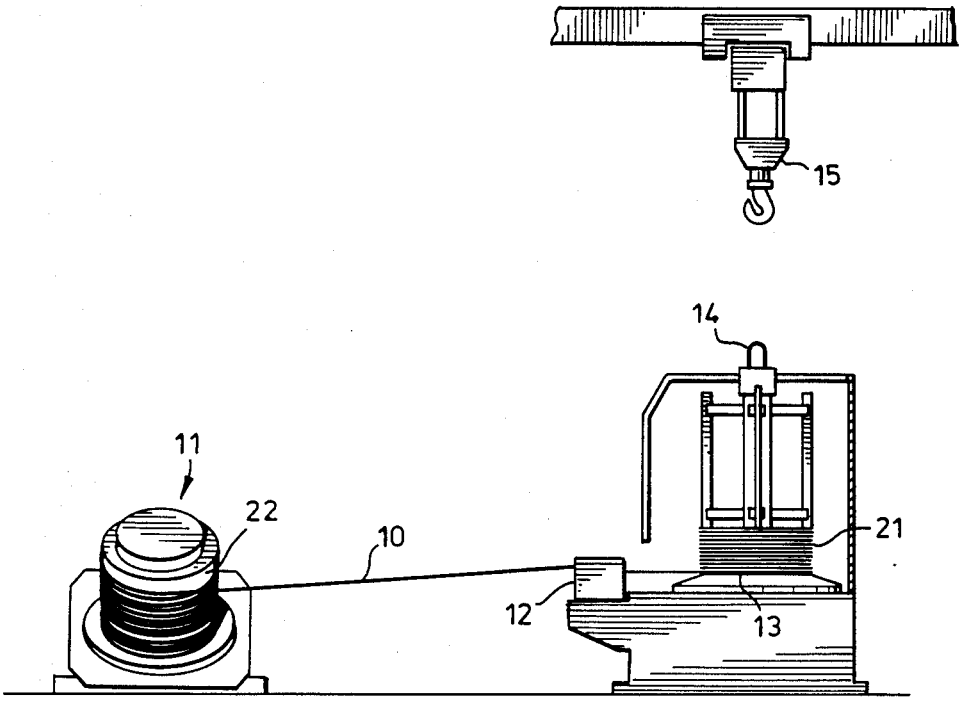
FIG. 2 (PRIOR ART)

Two well-known and established methods and apparatus for drawing wire are illustrated schematically in FIGS. 1 and 2. Referring to those Figures, rod 10 is supported in the form of a coil 22 on a pay-off device 11. Pay-off device 11 in FIG. 1 is of the flipper type with its axis and the axis of rod coil 22 essentially parallel to the axis of the wire drawing die. A pay-off device of this type normally is used with rod having up to ½" diameter. Pay-off device 11 in FIG. 2 is of the rotating drum or cylinder type with its axis and the axis of rod coil 22 essentially at right angles to the axis of the wire drawing die. A pay-off device 11 of the type shown in FIG. 2 normally is used with rod having a diameter in excess of ½".

In both cases the apparatus of FIGS. 1 and 2 employs a die (not shown) in a die box 12, a rotating block 13 driven by a motor (not shown), a coil stripper 14 and an overhead crane 15.

The die is a cylindrical block of metal having a precisely profiled hole along its axis. The smallest part of the hole is equal to the diameter of the wire to be produced. A tungsten carbide insert may be provided at this section of the die to give longer die life.

In operation, one end of rod 10 is extended from rod coil 22 on pay-off device 11, straightened, reduced in diameter and passed through the die in die box 12. The reduced end of rod 10, after passing through the die, is attached via a puller chain (not shown) to block 13. Block 13 is rotated and acts as a capstan to draw rod 10 through the die where it is drawn down to the desired size of wire. Each successive wrap pushes the preceding wraps up block 13 and onto stripper 14. This process is continued until all of the rod has been drawn into wire. Overhead crane 15 is employed to lift off stripper 14 and the coil 21 of wire on it at the end of the drawing operation and then to re-install the empty stripper after wire coil 21 has been removed therefrom.

There are a number of disadvantages to the standard approach to single hole wire drawing typified by the apparatus of FIGS. 1 and 2:

(a) In theory, there is no limit to how fast wire may be drawn on a single hole machine of the type shown in FIG. 1 or FIG. 2. If sufficient power is available, wire may be drawn as fast as desired without adversely affecting the product. In practice, the speed is limited by how fast rod can be fed to the machine and how quickly the finished wire can be coiled. In the layout shown in FIG. 1, rod becomes tangled if it is pulled too quickly from the pay-off. The pay-off in FIG. 2 tends to become centrifugally unbalanced when rotated too quickly. In both cases wire on the block becomes centrifugally unstable at high speed. These are very serious problems and cannot be ignored. They are the major controlling factors in how fast wire can be drawn in fact.

(b) The lead end of the wire coil is attached to the block by a chain and gripper device. The gripper, by nature of its application, is fairly robust and heavy. This, too, tends to create a balancing problem, and the gripper must be restrained from flying away from the block.

(c) With certain product sizes, there is a problem with the coil of wire being produced tending to collapse on the stripper. In some cases small coils have to be produced because of this phenomena. The production of small coils is very time consuming, as will become evident from the description given below of a typical cycle.

(d) Time is lost in loading and, even worse, in unloading the product. A major downtime element in a normal machine cycle is the time taken to unload a completed coil and recover and replace the stripper for re-use.

A good way to understand some of the more subtle problems is to examine a typical machine cycle. Such cycles tend to vary with the product and may have any or all of the following features. Assume that the machine is stopped, has been emptied, and the stripper is in position ready to receive a new coil. Notice should be taken of the number of times that the machine is stopped during the cycle:

(a) Push lead end of rod coil through the die (manual),
(b) Attach puller dog,
(c) Start machine,
(d) Run 10–20 wraps on the block,
(e) Stop machine,
(f) Visually inspect product,
(g) Check size with micrometer,
(h) Wire tie top few coils,
(j) Tuck puller inside coil loops,
(k) Run machine,
(m) Stop machine just before end of coil,
(n) Attach hoist to stripper, lift slightly,
(p) Jog machine and lower stripper, Note: (n) and (p) are done to trap the trailing end of coil.

(q) Run remainder of coil,
(r) Stop machine,
(s) Lift off stripper with coil,
(t) Unload stripper,
(u) Replace empty stripper on block,
(v) Detach crane.

Typically, machine time efficiency is 35% to 40%.

In addition to the above operating disadvantages, there are some related physical drawbacks:

(a) A high building with overhead handling is required to allow stripper removal.

(b) A heavy building structure is required to support the overhead handling.

(c) Such installations occupy a large floor area, particularly due to the space required between the pay-off and block. In the embodiment of FIG. 1 this typically is 15–20'. In the embodiment of FIG. 2 it typically is 20–25'.

Wire also may be drawn using apparatus known as a deadblock in which the wire drawing die rotates about a stationary block. A typical deadblock apparatus is shown schematically in FIG. 3. Referring to that Figure, a die box 16 carrying a die (not shown) is mounted on a die carrier 17 which is rotated by a motor (not shown). Rod 10 on a pay-off drum 11 of the rotating type is drawn over sheaves 18 and 19 and passes through the rotating die. The wire drawn in the die of die box 16 is wrapped around a fixed block 20, which is in the form of a cylinder or drum, rather than around a rotating block 13 of the type shown in FIGS. 1 and 2.

The use of a deadblock gives some advantages over apparatus of the type shown in FIGS. 1 and 2 because the finished product (coil 21 of wire) does not rotate. Unfortunately, the design of deadblock equipment limits its economical use to smaller wire sizes. In this respect, in deadblock equipment the rod to be drawn into wire normally is fed along the axis of carrier 17 and has to negotiate several acute curves to pass over sheaves 18 and 19. Thus there is an inherent threading problem that limits the size of the rod that can be processed in deadblock equipment. In addition, there is a finite limit to the size of the rod that can be bent around sheaves 18 and 19 without exceeding the yield point of the material of which the rod is fabricated. Finally, with deadblock equipment a twist is induced in the material being processed each time die carrier 17 goes through a complete revolution. Even though this twist is relieved by the die, the imparting of a twist to the material is not desirable from a metallurgical point of view.

SUMMARY OF THE INVENTION

In accordance with this invention there are provided wire drawing methods and apparatus which overcome many of the disadvantages noted hereinbefore of prior art methods and apparatus discussed hereinbefore.

Various aspects of the invention are as follows:

Wire drawing apparatus for drawing wire from a coil of material and winding it as a coil of wire, said apparatus comprising wire take-up means on which a coil of wire is adapted to be wound, the take-up means and the coil of wire when wound thereon having parallel longitudinal axes; a rotatable pay-off means on which a coil of material is adapted to be supported with the longitudinal axis of said coil of material when so supported being parallel to the axis of rotation of the pay-off means; a rotatable wire drawing die located between the take-up means and the pay-off means; means for rotating the wire drawing die about an axis of rotation; and differential speed compensating drive means for driving the pay-off means in the same direction as the wire drawing die and at a speed which compensates for any elongation of the material being drawn into wire as the material is passed through the die; the longitudinal axis of said take-up means, the axis of rotation of said pay-off means and the axis of rotation of the wire drawing die all being parallel to each other.

A method for drawing wire from a coil of material and winding it as a coil of wire which comprises providing a rotatable material pay-off means on which a coil of material is supported, the pay-off means being rotatable about an axis and the coil of material having its axis parallel thereto; a wire take-up means on which a coil of wire drawn from the material is adapted to be wound with its axis parallel to the longitudinal axis of the take-up means; and a rotatable die located between the pay-off means and the take-up means and rotatable about an axis of rotation, the axis of said take-up means and said axes of rotation of the die and the pay-off means being parallel to each other; transferring the material from the coil of material to the coil of wire while substantially retaining its coil form and passing the material through the die while rotating the die in a plane between the two coils to draw wire from the material; and rotating the pay-off means and the coil of material in the same direction as the die is rotated and at a speed just sufficient to compensate for the elongation of the material as it is drawn into wire.

DETAILED DESCRIPTION OF THE INVENTION INCLUDING THE PREFERRED EMBODIMENT

As will become more apparent hereinafter, in accordance with an aspect of this invention the material being processed is substantially left in coil form during the whole processing operation, rather than taking a coil of rod, semi-straightening it, drawing it into wire and then re-forming it into a coil again, as is characteristic of the techniques shown in each of FIGS. 1, 2 and 3. In accordance with another aspect of the invention the pay-off and take-up coils are kept as stationary as possible while the material being processed is moved through a rotating die and drawn. This avoids the problems inherent in prior art wire drawing equipment resulting from tangling of coils rotating at high speed and imbalance of masses rotating at high speed.

Figure 3:
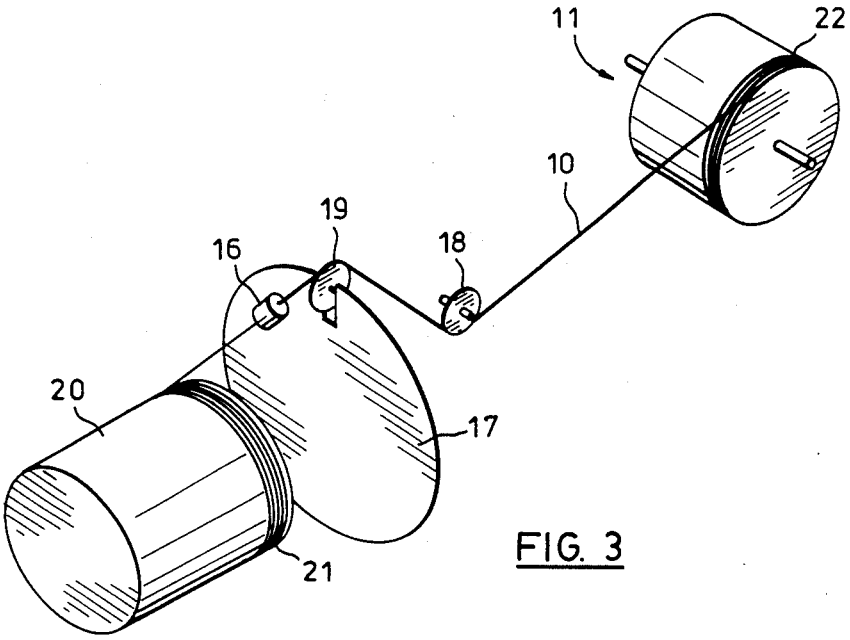
FIG. 3 is a schematic representation of another type of prior art wire drawing apparatus.
Figure 4:
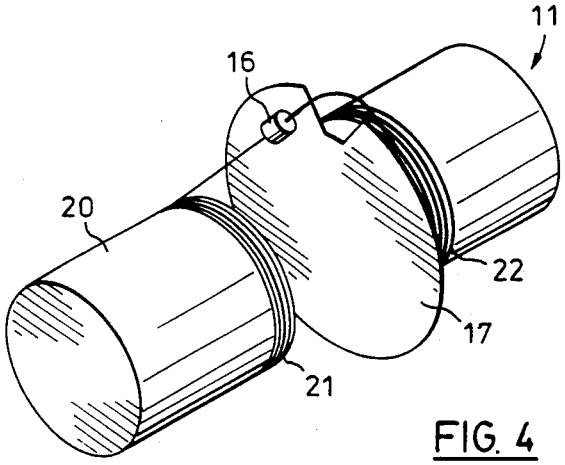
FIG. 4 is a schematic representation of wire drawing apparatus embodying the present invention.

A schematic representation of the present invention is shown in FIG. 4. In that embodiment, as in the prior art deadblock apparatus of FIG. 3, there is a fixed block 20 on which the wire is wound, a rotating die carrier 17, a die box 16 and die fixed to carrier 17 and rotating therewith and a pay-off device 11. The axis of wire coil 21 formed on fixed block 20, the axis of rotation of die carrier 17 and the axis of rod coil 22 on pay-off device 11 are parallel to each other in FIG. 4, however, whereas in FIG. 3 the axes of rod coil 22 and pay-off device 11 are perpendicular to the axes of wire coil 21 and die carrier 17. Indeed, in the preferred embodiment of the invention shown in FIG. 4, the named axes are coaxial. This seemingly minor distinction coupled with what effectively amounts to moving the die along the coil unexpectedly provides the substantial advantages of the present invention over the prior art, as will become more apparent hereinafter.

Figure 5:
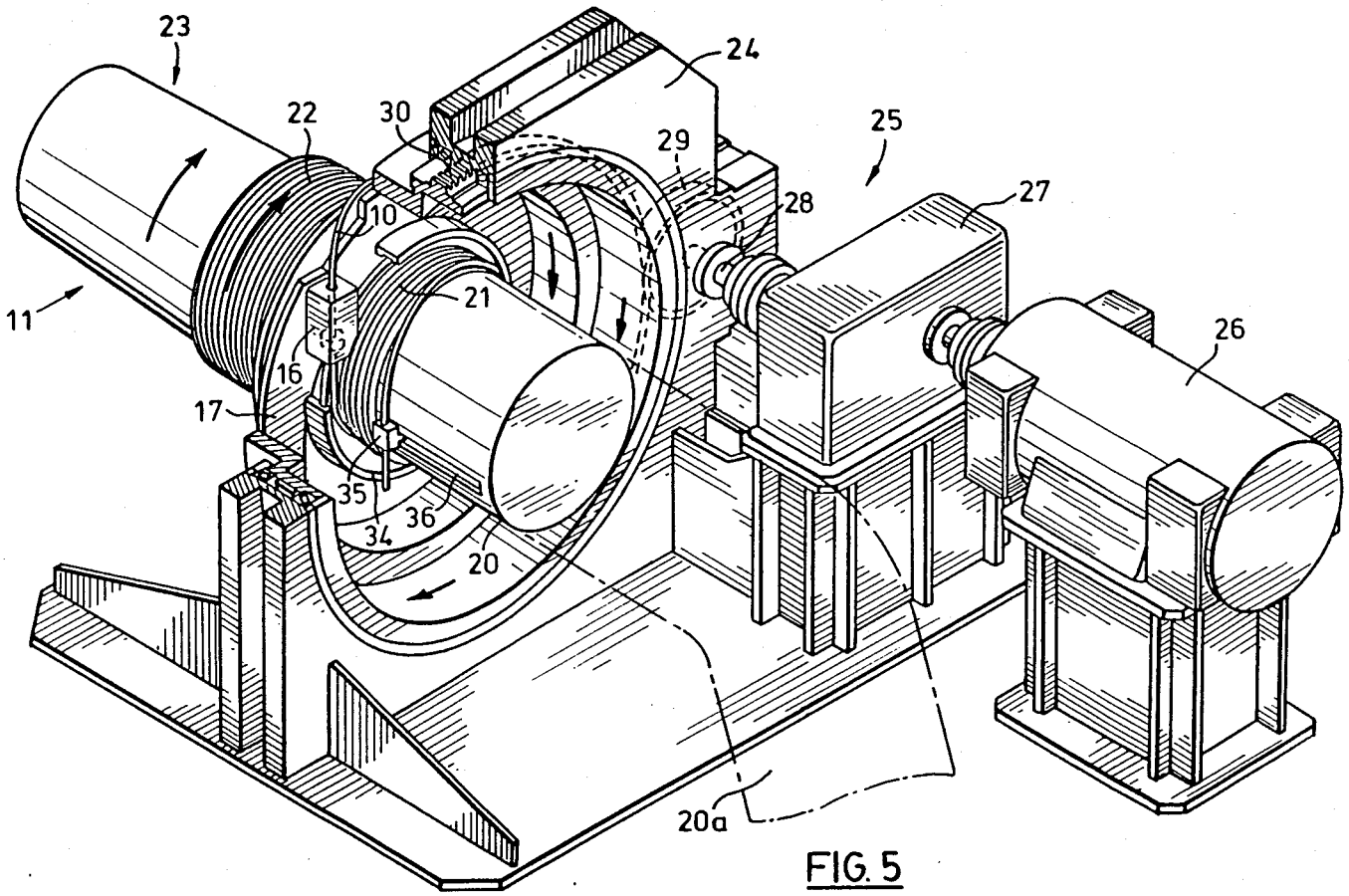
FIG. 5 is a more detailed perspective view, partly broken away, of a preferred embodiment of the present invention.

Referring now to FIG. 5, a preferred embodiment of the present invention is shown. It includes a stationary block 20 in the form of a drum or cylinder on which a coil 21 of wire is wound, a rotating die carrier 17, a die box 16 fixed to and carried by carrier 17 and containing a wire drawing die, a pay-off device 11 on which there is a coil 22 of rod 10, a differential speed compensating drive 23 between carrier 17 and pay-off device 11, a housing 24 and drive means 25 for rotating carrier 17. The axes of block 20, carrier 17 and pay-off device 11 are coaxial.

In the embodiment illustrated, the latter means 25 include a motor 26, e.g., an electric or hydraulic motor, driving a gear reduction unit 27 whose output shaft 28 drives a gear 29 that meshes with and drives a ring gear 30 that is secured to carrier 17.

Figure 6:
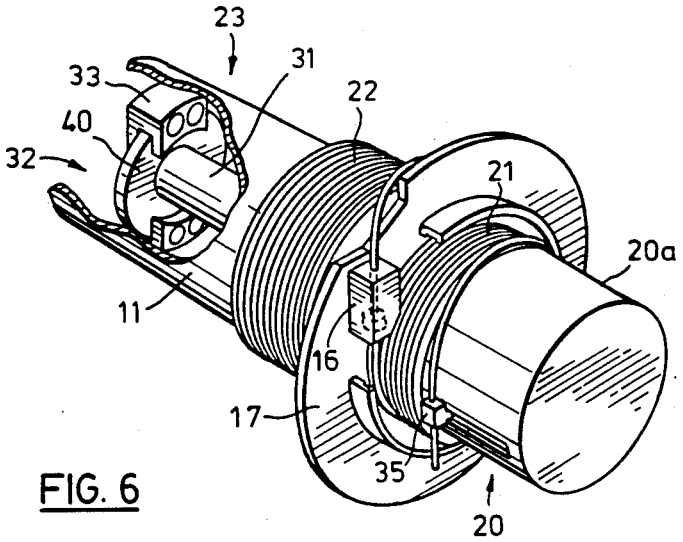
FIG. 6 is a perspective view, partly broken away, showing the differential speed compensating drive of FIG. 5 in greater detail.

In the embodiment illustrated, and as best shown in FIG. 6, differential speed compensating drive 23 is of the automatic type and includes a shaft 31 to which is affixed a brake disc 32, shaft 31 being secured to carrier 17 and rotating therewith. Differential speed compensating drive 23 also includes brake calipers 33 that are fixed to the inner surface of pay-off device 11, the latter constituting a flanged, hollow drum that is free to rotate on shaft 31 when the brake constituted by brake disc 32 and calipers 33 is released. In practice, in order to permit some slippage between pay-off device 11 and carrier 17, brake calipers 33 are set to engage brake disc 32 lightly so that pay-off device 11, in the absence of rod 10, would rotate at the same speed as carrier 17 but is capable of rotating at a different speed than that of carrier 17 by virtue of the presence of differential speed compensating drive 23.

In another embodiment (not shown) the differential speed compensating drive may be a motor connected to drive pay-off device 11 at a speed proportional to the reduction in area of rod 10 as it is drawn into wire. In such a system some means for sensing the reduction in area or increase in elongation of the material would be provided and would control the operation of the differential speed compensating drive motor.

Other types of differential speed compensating drives may be used without departing from this invention in its broadest aspect.

The operation of the apparatus shown in FIGS. 4, 5 and 6 now will be discussed and compared with the operation of the apparatus shown in FIG. 3. Inherent in this discussion will be a description of the preferred method of carrying out the present invention.

As rod is drawn into wire, its cross-section is reduced. Hence, its length must increase proportionally. For example, if the reduction in area (R.I.A.) is 30%, then the increase in length would be about 43%. In this respect, $$\text{Elongation} = (100 \times \text{R.I.A.})/(100 - \text{R.I.A.})$$

Using 30% R.I.A. for the purposes of explanation throughout, and referring to FIGS. 4, 5 and 6 as the die produces ten wraps of wire around fixed block 20, only seven coils of rod 10 are required (this assumes substantially equal rod and wire coil diameters). Consequently, rod coil 22 must be induced to rotate three times in the same direction as the die during the production of ten wraps of wire coil 21. This is achieved by differential speed compensating drive 23. In this respect, as previously noted, rod coil 22 is supported on pay-off drum 11 that is free to rotate relative to shaft 31, the latter being attached to die carrier 17 and rotating at the same speed as die carrier 17 and the die. Brake disc 32, being fixed to shaft 31, also rotates at the same speed as the die. With brake calipers 33 set to engage brake disc 32 very lightly, pay-off drum 11 tries to rotate at the same speed and in the same direction as the die. However, the speed at which pay-off drum actually rotates is governed by the wire demand and, although pay-off drum 11 tends to rotate at the same speed as the die, it is prevented from doing so by the product. The effect is fully self-regulating. There is no synchronization problem.

By way of contrast, and referring to FIG. 3, for a 30% R.I.A. pay-off device 11 must rotate at 70% of the die speed toward the die. With the apparatus of this invention (FIG. 4), pay-off device 11 rotates at 30% of the die speed in the same direction as that in which the die rotates to maintain the relative speed between the die and pay-off device 11 at 70% of the die speed. In other words, $30 = 100 - 70$.

Using a base die speed of 100 R.P.M., the resulting pay-off device speeds are 70 R.P.M. (FIG. 3) and 30 R.P.M. (FIGS. 4 and 5). Since centrifugal force is proportional to the speed of rotation squared, this factor is very significant. Simply stated, the ratio of the advantage gained is $70^2/30^2$ or 5.4:1.

In other respects the operation of the apparatus shown in FIGS. 4, 5 and 6 is similar to that of the apparatus shown in FIG. 3. The lead end of the rod coil 22 is reduced, pushed through the die and attached to a puller 35 which, in turn, is attached to block 20. Carrier 17 then is rotated in the direction shown by the arrows in FIG. 5 which, in effect, causes the die to travel in essentially the same path as the coil of material that bridges rod coil 22 and wire coil 21 and drawing wire from the rod, the wire being coiled on block 20 in coil 21. One difference of substance in this step between the operation of deadblock apparatus of the type shown in FIG. 3 and apparatus embodying the present invention is that in the latter die box 16 in effect moves along the coil, the rod is not bent over pulleys or the like, and no single twist per turn of carrier is imparted to the material being processed. In other words, in the practice of the present invention rod 10 is maintained and transferred in substantially the form of a coil between pay-off device 11 and take-up device 20 and passes through the die, which rotates in a plane between the pay-off and take-up devices.

If desired, wire wound on block 20 may be continuously removed therefrom over an extension of block 20 shown in FIG. 5 in phantom outline at 20*a*. To this end, as is known in conventional deadblock apparatus, puller 35, while secured to block 20, is capable of lateral movement in a channel 36 in block 20, and as coil 21 builds up, puller 35 will move to the end of channel 36 remote from die carrier 17. Puller 35 is provided with an internal locking mechanism (not shown) for holding the free end of the wire. The locking mechanism may be released automatically when puller 35 reaches the aforementioned end of channel 36, allowing continuous removal of the wire over the block extension. Of course, as also is conventional with a standard deadblock apparatus, a pressure pad (not shown) may be employed to sandwich the part of wire coil 21 nearest to die carrier 17 between the pressure pad and block 20, thus increasing the frictional grip between the wire and block 20. This will ensure retention of that part of the wire coil on block 20 when the locking mechanism in puller 35 is released.

In a preferred embodiment of the invention a shroud 34 (FIG. 5) in the form of a part annulus is secured to carrier 17 on the side thereof adjacent block 20. It serves to trap the tail end of the wire, eliminating the need to stop the apparatus as the tail end of rod coil 22 is being approached, a disadvantage inherent in prior art equipment of the type shown in FIGS. 1 and 2.

Figure 7:
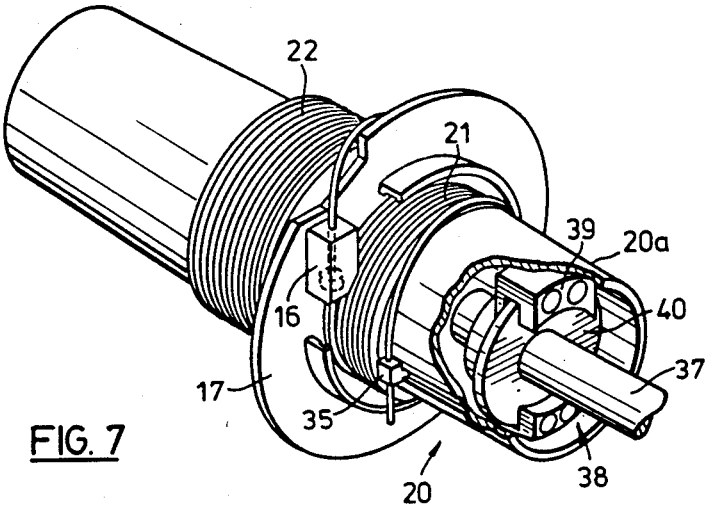
FIG. 7 is a perspective view, partly broken away, of another form of take-up device that may be used in the practice of this invention.

In the case of single hole wire drawing, block 20 normally will be stationary. It would be possible for block 20 to be controllably rotated, however. This may be achieved, for example, as shown in FIG. 7 by making block 20 in the form of a drum 20*a* that is rotatable on a rotating shaft 37, a differential speed compensating drive 38 like differential speed compensating drive 23 being employed between shaft 37 and drum 20*a*. With such an arrangement, with shaft 37 held stationary and the brake calipers 39 of drive 38 firmly locked to the brake disk 40 of drive 38, drum 20*a* will be held stationary. With the brake partly released, limited or controlled rotation of drum 20*a* is possible. Such a technique or a similar technique may have to be employed where apparatus embodying the invention is used for multiple hole wire drawing, the block 20 of one unit becoming the rotatable pay-off device of the next unit.

Apparatus and methods embodying the present invention may be used for drawing any ferrous or non-ferrous metals which lend themselves to being drawn, e.g., steel, copper and aluminum.

Compared with apparatus of the type shown in FIGS. 1 and 2, many of the problems and stoppages inherent therein are overcome by apparatus embodying the present invention. More specifically:

(a) The centrifugal balance problem or tangle problem at the pay-off device have been substantially reduced.

(b) The centrifugal balance problem at the take-up block has been eliminated, since the take-up block does not rotate. A deadblock does have this advantage, but is limited in the sizes of product it can run economically.

(c) The gripper does not rotate and, therefore, no longer creates a balancing problem.

(d) Collapsing of the product no longer occurs, since it is not piled vertically on the block.

(e) The apparatus does not have to be stopped to inspect the product. The wire may be inspected and even measured with the apparatus running.

(f) It is no longer necessary to tuck in the chain and gripper.

(g) The apparatus may be run to the end of the coil without stopping.

(h) There is no stripper to be removed and replaced, representing a substantial time saving.

(j) A relatively low building can be used to house the equipment, since there is no stripper to be lifted.

(k) No overhead handling is required.

(l) The space occupied is significantly reduced.

(m) Improved product quality results from elimination of excessive plastic deformation caused by partial straightening of the rod in other drawing methods.

As compared with a standard deadblock apparatus, the same limitations as to the size of the rod that can be processed do not exist, and the speed of operation can be substantially greater.

While preferred embodiments of the invention have been described and illustrated herein, persons skilled in the art will appreciate that changes and modifications may be made therein without departing from the spirit and scope of this invention as defined in the appended claims.

The embodiments of the invention in which an exclusive property of privilege is claimed are defined as follows:

1. Wire drawing apparatus for drawing wire from a coil of material and winding it as a coil of wire, said apparatus comprising wire take-up means on which a coil of wire is adapted to be wound, the take-up means and the coil of wire when wound thereon having parallel longitudinal axes; a rotatable pay-off means on which a coil of material is adapted to be supported with the longitudinal axis of said coil of material when so supported being parallel to the axis of rotation of the pay-off means; a rotatable wire drawing die located between the take-up means and the pay-off means; means for rotating the wire drawing die about an axis of rotation; and differential speed compensating drive means for driving the pay-off means in the same direction as the wire drawing die and at a speed which compensates for any elongation of the material being drawn into wire as the material is passed through the die, said differential speed compensating means permitting relative rotational movement between said payoff means and rotating wire drawing die; the longitudinal axis of said take-up means, the axis of rotation of said pay-off means and the axis of rotation of the wire drawing die all being parallel to each other.

2. Apparatus according to claim 1 wherein the wire take-up means is stationary.

3. Apparatus according to claim 1 wherein the wire take-up means is controllably rotatable.

4. Apparatus according to claim 1 wherein the longitudinal axis of the take-up means, the axis of rotation of the pay-off means and the axis of rotation of the wire drawing die all are coaxial.

5. Apparatus according to any of claim 1 wherein the differential speed compensating drive means comprise means driven at the same speed as the die and on which the pay-off means is rotatably mounted, and slipping brake means between said driven means and the pay-off means.

6. Apparatus according to claim 1 wherein the differential speed compensating drive means comprise means driven at the same speed as the die and on which the pay-off means is rotatably mounted, and slipping brake means between said driven means and the pay-off means, and wherein the longitudinal axis of the take-up means, the axis of rotation of the pay-off means and the axis of rotation of the wire drawing die all are coaxial.

7. A method for drawing wire from a coil of material and winding it as a coil of wire which comprises providing a rotatable material pay-off means on which a coil of material is supported, the pay-off means being rotatable about an axis and the coil of material having its axis parallel thereto; a wire take-up means on which a coil of wire drawn from the material is adapted to be wound with its axis parallel to the longitudinal axis of the take-up means; and a rotatable die located between the pay-off means and the take-up means and rotatable about an axis of rotation, the axis of said take-up means and said axes of rotation of the die and the pay-off means being parallel to each other; transferring the material from the coil of material to the coil of wire while substantially retaining its coil form and passing the material through the die while rotating the die in a plane between the two coils to draw wire from the material; and rotating the pay-off means and the coil of material in the same direction as the die is rotated and at a speed just sufficient to compensate for the elongation of the material as it is drawn into wire while permitting relative rotational movement between said payoff means and wire drawing die.

8. A method according to claim 7 wherein the axis of the take-up means and said axes of rotation are coaxial.

9. A method according to claim 7 wherein the take-up means is maintained stationary.

* * * * *